United States Patent [19]

Vrana

[11] Patent Number: 4,750,317

[45] Date of Patent: Jun. 14, 1988

[54] CASE PACKING APPARATUS

[75] Inventor: Josef F. Vrana, Roseneath, Canada

[73] Assignee: General Foods Inc., Don Mills, Canada

[21] Appl. No.: 48,184

[22] Filed: May 11, 1987

[51] Int. Cl.[4] ..... B65B 35/52

[52] U.S. Cl. ..... 53/541; 53/247; 53/249

[58] Field of Search ..... 53/249, 250, 251, 252, 53/540, 541, 566, 255, 258, 247

[56] References Cited

U.S. PATENT DOCUMENTS

| | | | |
|---|---|---|---|
| 708,218 | 9/1902 | French | 53/249 X |
| 2,941,339 | 6/1960 | Salwasser | 53/247 X |
| 2,956,381 | 10/1960 | Chauvin et al. | 53/247 X |
| 3,430,416 | 3/1969 | Clark et al. | 53/252 X |
| 3,724,185 | 4/1973 | Berney | 53/249 X |
| 4,224,781 | 9/1980 | Salenbo | 53/249 X |
| 4,534,153 | 8/1985 | Nowicki | 53/252 X |
| 4,537,008 | 8/1985 | Bonz | 53/250 X |
| 4,679,379 | 7/1987 | Cassoli | 53/540 X |

*Primary Examiner*—Robert L. Spruill
*Assistant Examiner*—Steven P. Weihrouch
*Attorney, Agent, or Firm*—Linn I. Grim; D. J. Donovan

[57] ABSTRACT

A case packing apparatus comprising a stacking assembling, a case positioning assembly, and a pusher assembly. The stacking assembly is provided to form a stack of articles; the case positioning assembly is provided to receive a case in a receiving position and to move the case to a loading position, wherein an open end of the case is located adjacent that stack of articles; and the pusher assembly is provided to push the stack of articles into the case. The case positioning assembly includes an engagement member and a pivot arm that is spaced from the engagement member when the case is in the receiving position; and, as the case is moved toward the loading position, the pivot arm engages the engagement member and pivots the case about an upwardly moving axis to move the case into its loading position.

9 Claims, 4 Drawing Sheets

CASE PACKING APPARATUS

BACKGROUND OF THE INVENTION

This invention generally relates to case packing apparatus or machines, and more specifically, to such apparatus or machines including an assembly to move a case into a preferred orientation to receive a stack of articles.

Automated machines are often used to pack articles into cases; and commonly such machines include a stacking assembly to form a stack of the articles, a case positioning assembly to position an open end of a case adjacent the stack of articles, and a pusher assembly to push the stack of articles into the open case. Typically, such case packing machines are employed in conjunction with other automated machines that are used to form the case from a flat blank, deliver the formed case to the case packing machine, and then close and seal the case after it has been loaded. In operation, commonly, the case packing machine receives a case in a first or receiving position and moves it to a second or loading position, where the case then receives the stack of articles; and after the case is loaded, it is either returned to the first, receiving position, or moved to a third position, from where the case is removed for further handling.

It is often desirable to use a particular case packing machine with cases having different sizes. Typically, however, individual prior art case packing machines are not designed to be used readily with different size cases; and, to do this, it is necessary to make very time consuming, and thus expensive, adjustments or changes to the machine. Moreover, movement of a case between the above-discussed positions may involve a number of types of motion such as both lifting and pivoting, or pivoting about a plurality of different axes, and normally a relatively complicated mechanism has been needed in order to guide and move the case along the desired path.

SUMMARY OF THE INVENTION

An object of this invention is to improve case packing machines.

Another object of this invention is to provide a case packing machine that is very easy to adjust to use the machine with different size cases.

A further object of the present invention is to provide a case packing machine with a relatively simple mechanism that both moves a case upward and swings the case about a pivot axis, to move the case into a position in which it is loaded with a stack of articles.

Still another object of this invention is to provide a case packing machine with an assembly employing a single motive means both to move the case upward and to swing the case about a pivot axis, to move the case into a loading position.

These and other objectives are attained with a case packing apparatus comprising a stacking assembly, a case positioning assembly, and a pusher assembly. The stacking assembly is provided to receive a plurality of articles and to form a stack thereof; and the case positioning assembly is located adjacent the stacking assembly, and is provided to receive a case in a receiving position, and to move the case to a loading position, wherein an open end of the case is located adjacent the stack of articles formed by the stacking assembly. The pusher is also located adjacent the stacking assembly and is provided to push that stack of articles into the open end of the case.

The case positioning assembly includes case support means for receiving and supporting the case; and means connected to the case support means to move that case support means between lower and raised positions, and to pivot the case support means about a pivot axis as the case support means moves from the lower position to the upper position to move the case into the loading position. Preferably, the case support means includes a frame, and arm means connected to the frame and extending forward therefrom to receive and support the case. These arm means are releasably connected to the frame, and the case positioning assembly may be adjusted to use cases of different sizes simply by changing the location of the arm means on the frame.

The case positioning assembly may further include support and guide means; slide means connected to the support and guide means and supported thereby for upward and downward movement; and means connecting the case support means to the slide means, first, for upward and downward movement therewith, and second, for pivotal movement relative to the slide means about the pivot axis.

Also, with a preferred embodiment, the above-mentioned means to move the case support means between its lower and raised positions includes motive means connected to the slide means to move the slide means along the support and guide means between lower and raised positions of the slide means, a pivot arm connected to the case support means and extending rearward of the pivot axis, and an engagement member connected to and supported by the support and guide means rearward of the pivot axis and above the pivot arm. The pivot arm is spaced from the engagement member when the slide means is in its lower position, and the pivot arm engages the engagement member and pivots the case support means to move the case into the loading position as the slide means is raised from its lower position and into its raised position.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
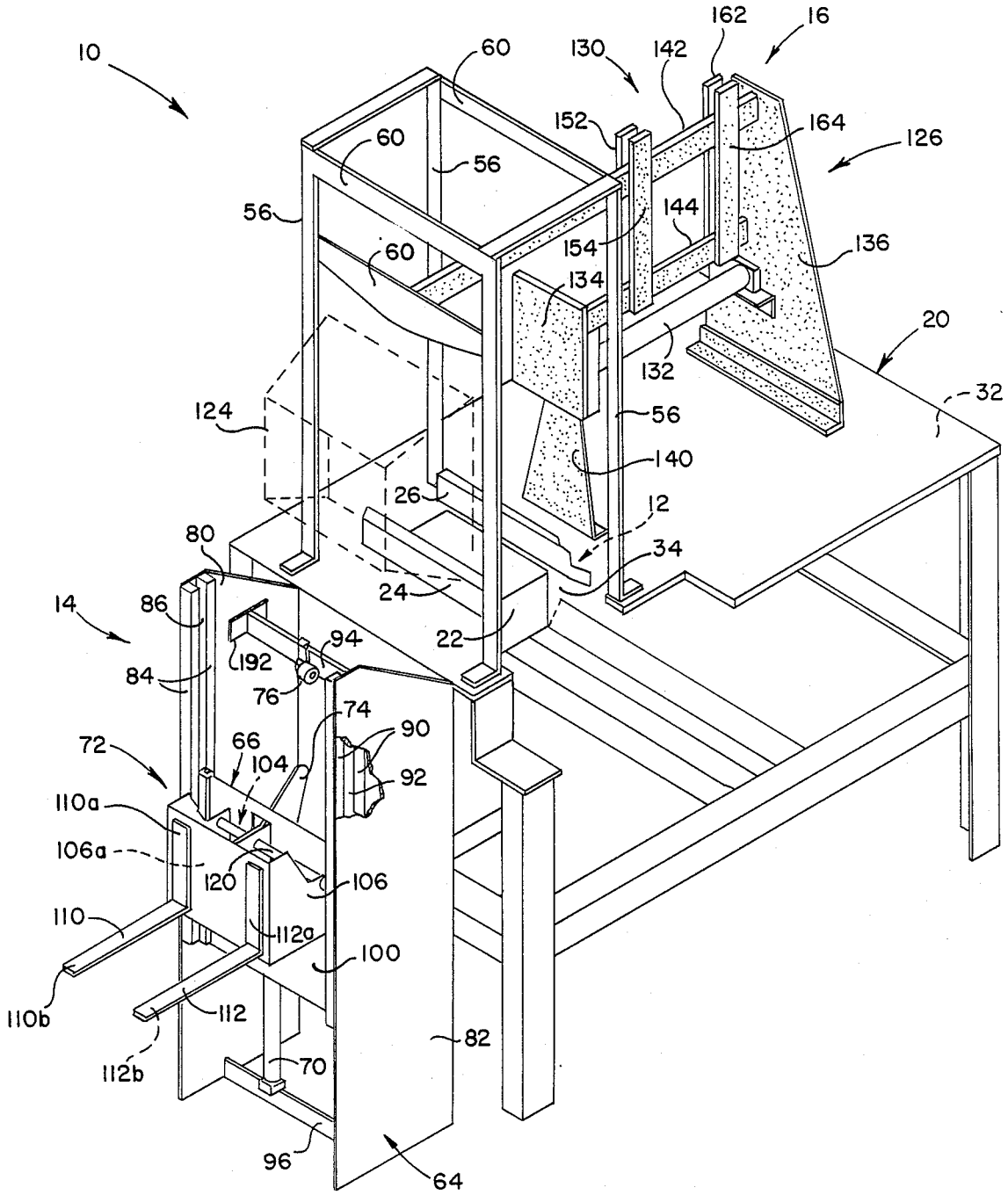
FIG. 1 is a perspective view of a case packing apparatus in accordance with a preferred embodiment of the invention.
Figure 2:
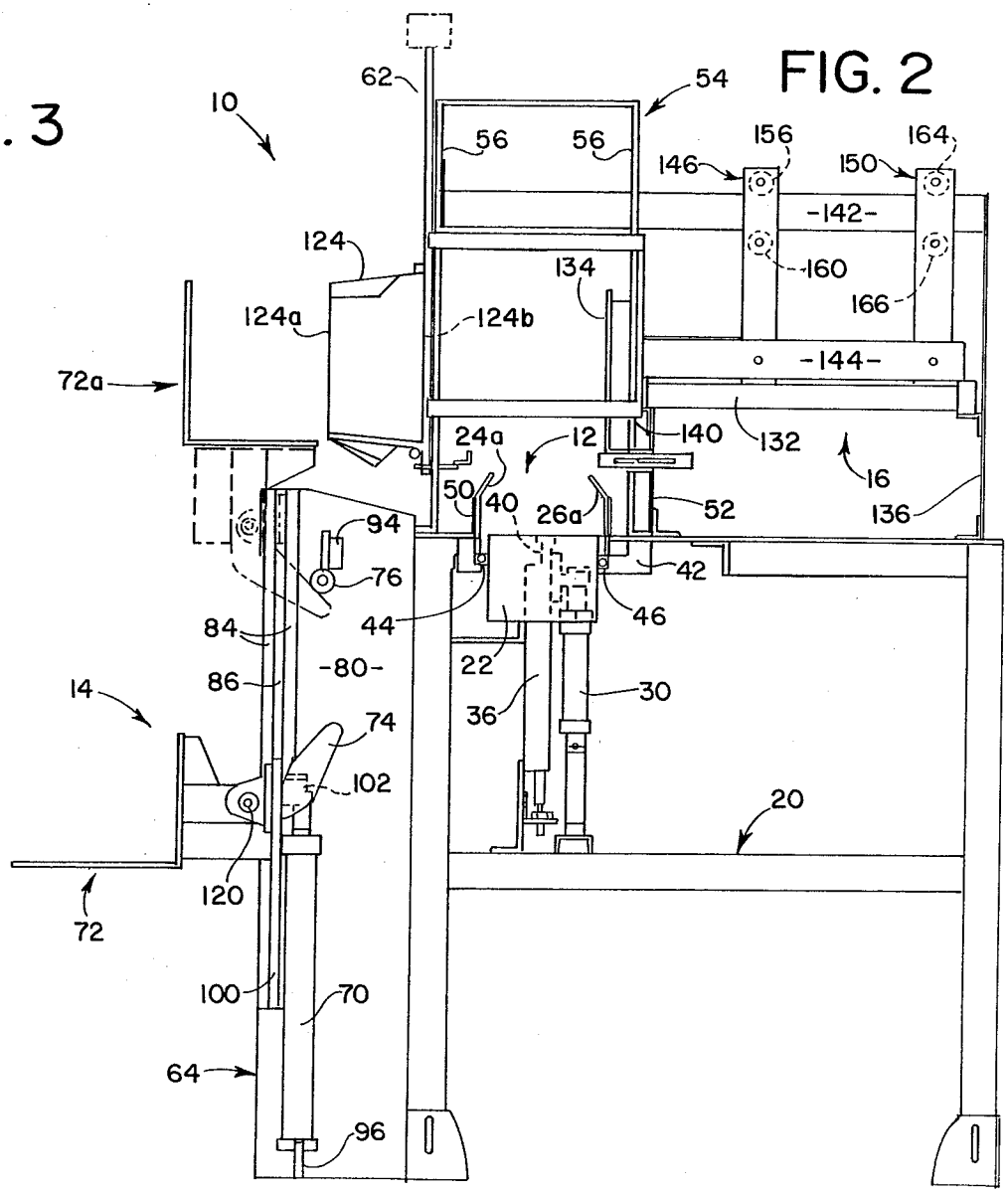
FIG. 2 is a side-view of the apparatus shown in FIG. 1, with portions of the apparatus removed.
Figure 3:
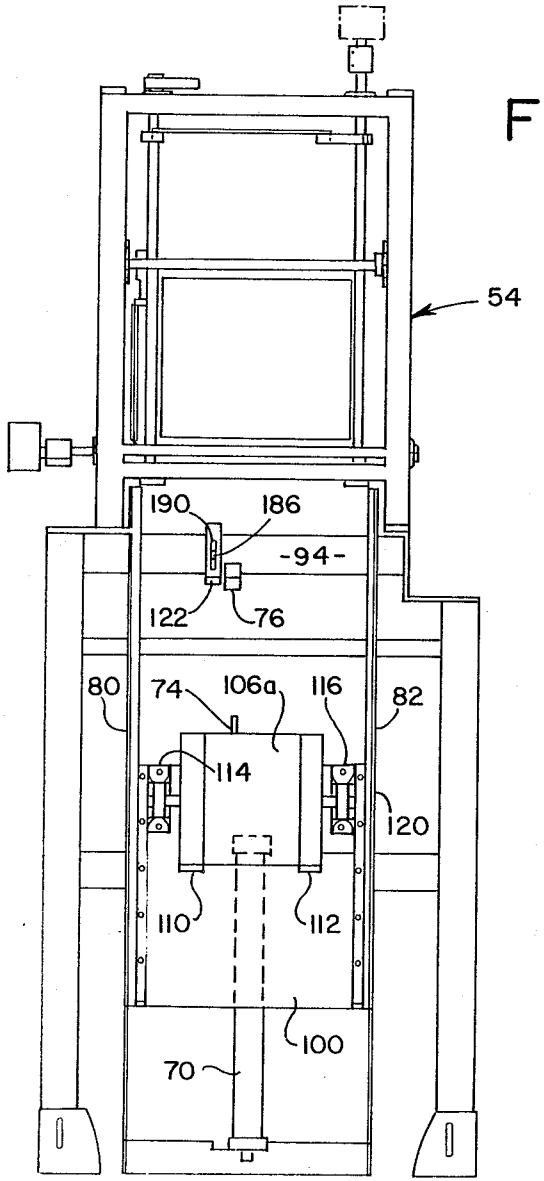
FIG. 3 is a front view of the case packing apparatus.

FIGS. 1, 2 and 3 illustrate case packing apparatus or machine 10 generally comprising a stacking assembly 12, case positioning assembly 14 and pusher assembly 16. Generally, stacking assembly 12 is provided to receive a plurality of articles and to form a stack thereof; and case positioning assembly 14 is located adjacent stacking assembly 12 and is provided to receive a case in a first or receiving position and to move the case between that position and a second or loading position in which an open end of the case is located adjacent the stack of articles formed by the stacking assembly. Pusher assembly 16 is located adjacent stacking assembly 12 and is provided to push the stack of articles into the open end of the case. As shown in the drawings, stacking assembly 12 and pusher assembly 16 are securely connected to and supported by a primary support table or frame 20, and case positioning assembly 14 is located adjacent to, and is rigidly connected to, a front side of this primary frame. This specific supporting arrangement is not necessary to the present invention; and, for example, stacking, case positioning and pushing assemblies 12, 14 and 16 may each be supported independent of the other assemblies of apparatus 10.

Various mechanisms are known in the art to form a stack of articles, and any suitable article stacking mechanism may be employed in the practice of the present invention. With the preferred arrangement shown in the drawings, stacking assembly 12 includes a vertically moveable platform 22, front and back retaining members 24 and 26, and motive means such as hydraulic cylinder 30. More specifically, a top surface 32 of frame 20 forms a platform opening 34, and platform 22 is located in this opening, with the top surface of the platform approximately coplanar with top surface 32 of the primary support frame. A first end of a vertical, telescopic support member 36 is connected to frame 20, and a second, moveable end 40 of this telescopic support member is connected to platform 22 to support that platform while allowing vertical movement thereof. A first end of hydraulic cylinder 30 is connected to frame 20, and a second, extensible end of this cylinder is connected to the moveable end 40 of support member 36. With this arrangement, as cylinder 30 extends, the cylinder moves the second end 40 of support member 36 upward and this raises platform 22; and, analogously, when cylinder 30 retracts, it pulls down the second end of support member 36, and this pulls platform 22 down into its normal position shown in FIGS. 1 and 2.

Retaining plates 24 and 26 are located above platform 22 on opposite sides thereof, and these plates are connected to and supported by frame 20 for pivotal movement toward and away from each other. In particular, a pair of parallel, support brackets are connected to, and extend underneath, frame top 32, on opposite sides of platform 22. One of these brackets is shown at 42 in FIG. 2, while, for the sake of clarity, the other of these brackets is not shown in the drawings. These brackets rotatably support a pair of parallel shafts 44 and 46, and connecting plates 50 and 52 are connected to, and extend upward from shafts 44 and 46, respectively, for pivotal movement therewith. Retaining plates 24 and 26 are connected to upper portions of, and extend upward from, connecting plates 50 and 52 for pivotal movement therewith about the axes of shafts 44 and 46 respectively. Upper portion 24*a* of front retaining plate 24 slants upwardly rearwardly, over platform 22; while upper portion 26*a* of back retaining plate 26 slants upwardly forwardly, over platform 22. Springs (not shown) are connected to connecting plates 50 and 52 to bias those platesand retaining plates 24 and 26 toward their normal positions shown in FIGS. 1 and 2, while allowing plates 24 and 26 to pivot about shafts 44 and 46, respectively.

The operation of stacking assembly 12 is discussed in detail below. Generally, though, an article is placed on platform 22, and the platform is raised to lift the article upward past retaining plates 24 and 26 and onto the top edges of those retaining plates. As platform 22 rises, an article on the platform engages upper portions 24*a* and 26*a* of the retaining plates and forces those plates to pivot about shafts 44 and 46, away from platform 22. Once the article rises above the top edges of plates 24 and 26, those plates pivot back toward platform 22 under the influence of the above-mentioned springs, lifting the article off, and holding the article above, the platform. This procedure is repeated a number of times to form a stack of articles on the top edges of retaining plates 24 and 26.

A framework 54 may be provided to help hold upright the stack of articles formed on retaining plates 24 and 26. This framework 54 comprises four vertical posts 56 supported on and extending upward from frame top 32, and a plurality of connecting members 60 that are connected to these vertical posts to form a rigid framework extending completely around platform opening 34. Left and right vertical plates (not shown) may be located on or adjacent the left and right sides of framework 54 to help prevent articles from falling off any stack of articles formed inside that framework, and these left and right vertical side plates may be supported by or connected to means 62 allowing the side plates to move toward or away from each other to accommodate different stacks of different size articles.

Case positioning assembly 14 includes support and guide and means 64, slide means 66, motive means such as hydraulic cylinder 70, case support means 72, pivot arm 74, and engagement member 76. Preferably, support and guide means 64 includes parallel left and right side walls 80 and 82 that are rigidly connected to and extend forward from primary support frame 20. A pair of left rails 84 are connected to an inside surface of left side plate 80 to form a left, vertically extending channel 86; and a pair of right rails 90 are connected to an inside surface of right side plate 82 to form a right, vertically extending channel 92. Top and bottom brace members 94 and 96 may be connected to and extend between left and right sidewalls 80 and 82 to brace those sidewalls and to hold them spaced apart a preset distance.

Slide means 66 is mounted on support and guide means 64 and is supported and guided thereby for upward and downward sliding movement. With the embodiment of the invention shown in the drawings, slide means 66 comprises a generally flat plate 100 having a rectangular or square shape, and this plate extends into and is guided by left and right channels 86 and 92 for vertical sliding movement between lower and raised positions. Teflon strips may be mounted on the front and back sides of the lateral edges of plate 100 to hold the slide plate firmly in channels 86 and 92 and to help facilitate sliding movement of the plate against the rails 84 and 90 forming those channels.

Hydraulic cylinder 70 is connectd to plate 100 to move the plate upward and downward along support means 64, and in particlular, to slide the plate vertically along the guide channels 86 and 92 between lower and raised positions. Cylinder 70 may be connected to plate 100 in any suitable way; and for example, a top end of cylinder 100 may be connected to a pin mounted on a bracket 102 that, in turn, is fixed to a backside of the slide plate. As shown in the drawings, a bottom end of cylinder 70 is connected to bottom brace 96, helping to hold the cylinder in place relative to support and guide means 64, and preferably the cylinder is located approximately midway between sidewalls 80 and 82. As will be apparent to those of ordinary skill in the art, any other suitable type of motive means may be used to move plate 100, such as an extensible screw or an electric motor.

Case support means 72 extends forward of slide means 66 to receive and support a case; and connecting means, generally referenced at 104, connects case support means 72 to slide means 66, first, for upward and downward movement therewith, and second, for pivotal movement relative to the slide means. As will be appreciated, any suitable case support means 72 and connecting means 104 may be used in the practice of this invention in its broadest sense. Preferably, however, case support means 72 includes frame 106 and left and right arms 110 ans 112, and connecting means 104 includes left and right brackets 114 and 116 and support rod 120. Brackets 114 and 116 are connected to and extend forward from left and right sides of slide plate 100, respectively, and support rod 120 is supported by and laterally extends between these left and right brackets. Frame 106 of case support means 72 is connected to support rod 120 and is supported thereby for vertical movement with the support rod and for pivotal movement about the axis thereof. Frame 106 extends forward from support rod 120, and left and right arms 110 and 112 are releasably connected to and extend forward from frame 106.

Frame 106 has a generally U-shaped horizontal cross section, including left and right parallel side plates and a front plate **106*a* connected to and extending between front edges of these side plates. Each of arms 110, 112 includes a vertical section or portion 110*a*, 112*a* and a horizontal section or portion 110*b*, 112*b*; and vertical sections 110*a* and 112*a* of arms 110 and 112 are releasably secured to front plate 106*a*, for example by bolts. Horizontal sections 110*b* and 112*b* of arms 110 and 112 extend forward from front plate 106*a* of frame 106, and these horizontal arm sections are substantially coplanar and form a support base for a case. Preferably, support rod 120 is pivotally supported by brackets 114 and 116, and frame 106** is rigidly connected to the support rod, for example, by welding, for pivotal movement therewith about the axis of that support rod.

Pivot arm 74 is connected to case support means 72 and extends rearward of slide means 66, and engagement member 76 is connected to and is supported by support and guide means 64 rearward of the slide means and above the pivot arm. Pivot arm 74 is spaced from engagement member 76 when slide means 66 is in the lower position; and, in the operation of assembly 14, discussed in greater detail below, as slide means 66 moves upward into its raised position, pivot arm 74 engages member 76 and forces the case support means 72 to pivot about the axis of support rod 120, as illustrated at **72*a* in FIG. 2**, to move a case supported on the case support means, into the case loading position.

Preferably, engagement member 76 comprises a roller rotatably connected to bar 122 that, itself, is connected to top brace member 94; and pivot arm 74 is rigidly connected to a back side of front plate **106*a* of case support means 72, extends rearward therefrom, through an opening in slide plate 100 and to a position directly below roller 76. As shown in the drawings, support rod 120 extends through pivot arm 74 so that this arm also helps to support case support means 72 on that support rod. Further, as best shown in FIG. 3, roller 76 and pivot arm 74 are laterally slightly spaced from hydraulic cylinder 70** so that the roller and the pivot arm do not interfere with extension of the hydraulic cylinder.

Cone 124 is located adjacent stacking assembly 12 to help insure that a case is properly positioned as it moves into its loading position and to help guide a stack of articles into the case. More specifically, cone 124 is connected to and supported by framework 54, the cone extends forward therefrom, and the cone has four sides and open front and back ends **124*a* and 124*b*. Each side of cone 124 slants forwardly inwardly toward the central axis of the cone, front end 124*a* of the cone is designed to fit into the case used with apparatus 10, while back end 124*b* of the cone is designed so that the stack of articles formed on retaining plates 24 and 26** will fit into that end of the cone.

Many types of assemblies are known in the art to push a stack of articles into an open case, and any suitable pushing assembly 16 may be utilized in the practice of the present invention. The preferred pushing assembly 16 shown in the drawings includes stationary support frame 126, moveable support frame 130, extensible hydraulic cylinder 132, and moveable push plate 134. In turn, stationary frame 126 includes back leg 136, front leg 140 and top brace 142, and moveable support frame 130 includes bottom leg 144 and support arms 146 and 150. Back leg 136 rests on frame top 32 and extends upward therefrom, and a back end of brace 142 is connected to a top portion of leg 136, and this brace extends forward therefrom. A front end of brace 142 is connected to a cross member 60 of framework 54. Hydraulic cylinder 132 is connected to back leg 136, the cylinder extends forward therefrom along a generally horizontal axis, and push plate 134 is connected to a forward, extensible rod of the cylinder for forward and rearward movement therewith. Front leg 140 is connected to frame top 32, and this leg extends upward from the frame into engagement with a stationary, outer case of cylinder 134, providing additional support for that cylinder.

Support arms 146 and 150 are mounted on top brace 142 for sliding movement therealong. More specifically, arm 146 includes left and right bars 152 and 154 and upper and lower rotatable wheels 156 and 160; and likewise, arm 150 includes left and right bars 162 and 164 and upper and lower rotatable wheels 166 and 170. The bars 152, 154 and 162, 164 of each arm 146, 150 are located on opposite sides of top brace 142 and are connected together so that the bars are slidable along this top brace. Top wheel 156, 166 of each arm 146, 150 is rotatably held between the left and right bars of the arm, above and in engagement with the top edge of top brace 142, holding the arms thereon and facilitating sliding movement of the arms along the brace. Bottom wheel 160, 170 of each arm 146, 150 is rotatably held between the left and right bars of the arm, below and in engagement with the bottom edge of top brace 142, helping to hold the support arms in a preferred orientation relative to the top brace. Bottom leg 144 is securely connected to lower portions of both support arms 146 and 150; and leg 144 extends forward from these support arms, with a forward end of the bottom leg securely connected to push plate 134. As cylinder 132 extends and pushes plate 134 forward, support arms 146 and 150 and leg 144 move with the push plate and along top brace 142, providing a moveable support for the push plate over its entire length of travel.

The operation of apparatus 10 will now be described in detail with particular reference to FIGS. 1 and 4–7. In this operation, articles are fed onto the top surface of platform 22, and this may be done in any suitable way, either automatically or by hand, and a feeding chute (not shown) may be provided to feed the articles onto the platform. As is best understood from FIG. 4, after an article 174 is positioned on platform 22, the platform is raised to lift the article upward past the top edges of retaining plates 24 and 26. As article 174 approaches the top edges of plates 24 and 26, the article engages the plates and pushes them outward, away from each other so that the article passes upward past the top edges of the retaining plates.

Figure 5:
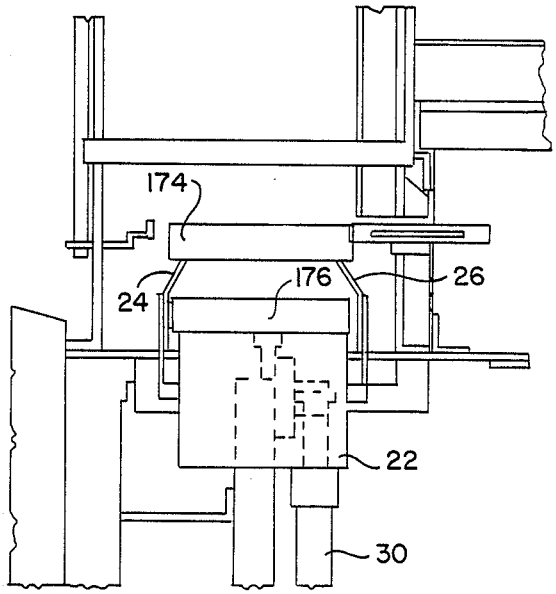

Once the article 174 is raised to a level above the top edges of plates 24 and 26, those retaining plates pivot back toward each other, into their normal position. As retaining plates 24 and 26 do this, they push article 174 up and off platform 22; and after the article is removed from the platform, the platform is lowered back into its normal position. With reference to FIG. 5, when platform 22 is back in its normal position, a second article 176 is placed on it, and the platform is elevated to lift that second article upward past the top edges of retaining plates 24 and 26. As article 176 approaches the top edges of plates 24 and 26, the article 176, first, pushes the retaining plates outwardly, and second, moves upward into engagement with article 174. Platform 22 continues to move upward and raises both articles 174 and 176 to a level above the top edges of retaining plates 24 and 26. Retaining plates 24 and 26 then pivot back inward into their normal position; and as they do this, the retaining plates lift both articles 174 and 176. Platform 22, without any articles resting on it, is then lowered back into its normal position.

The above sequence of events is repeated a desired number of times to form a stack of a desired number of articles, with the bottom article of the stack resting directly on the top edges of retaining plates 24 and 26 and with each successively higher article resting directly on the article immediately below it. As will be understood by those skilled in the art, the stack may be formed one article at a time, or by lifting a group of articles at a time. Such a group may comprise, for example, two articles one on top of the other, or located side by side.

Figure 6:
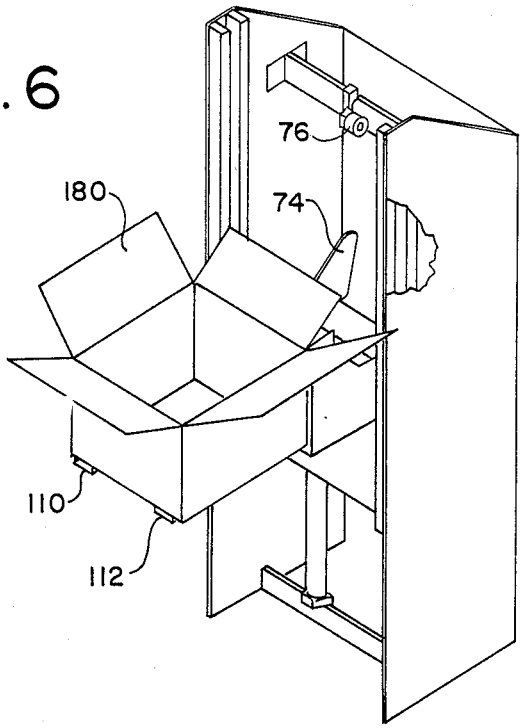
FIG. 6 depicts another portion of the case packing apparatus, and also illustrates a packing case that may be used with the apparatus.
Figure 4:
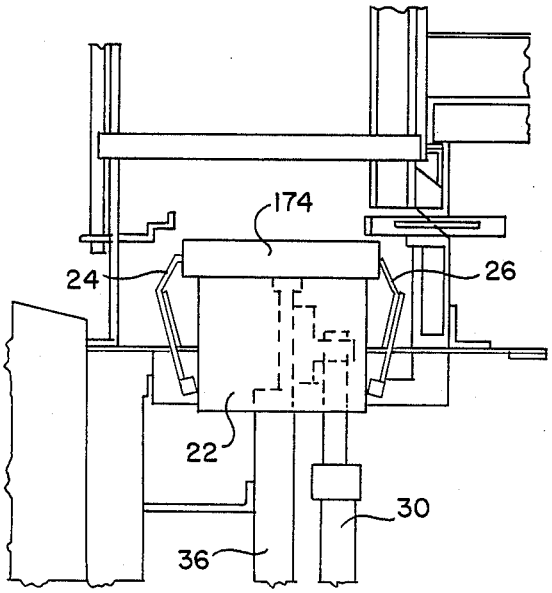
FIGS. 4 and 5 show portions of the case packing apparatus, and in particular, illustrate how a stack of articles may be formed by the apparatus.

While or after the stack of articles is being formed, a case is positioned on case support means 72, as illustrated in FIG. 6, and this may be done by hand and or automatically. Many types of cases may be used with apparatus 10, although the apparatus is specifically designed for use with cases of the type having a square or rectangular horizontal cross section and comprising four vertical side panels, a closed bottom end and an open top end. Such a case is positioned on case support means 72 with the bottom end of the case resting directly on arms 110 and 112, with one of the side panels of the case parallel to and adjacent, or closely adjacent, front plate 106*a* of frame 106, and with the open end of the case located at the top thereof.

Figure 7:
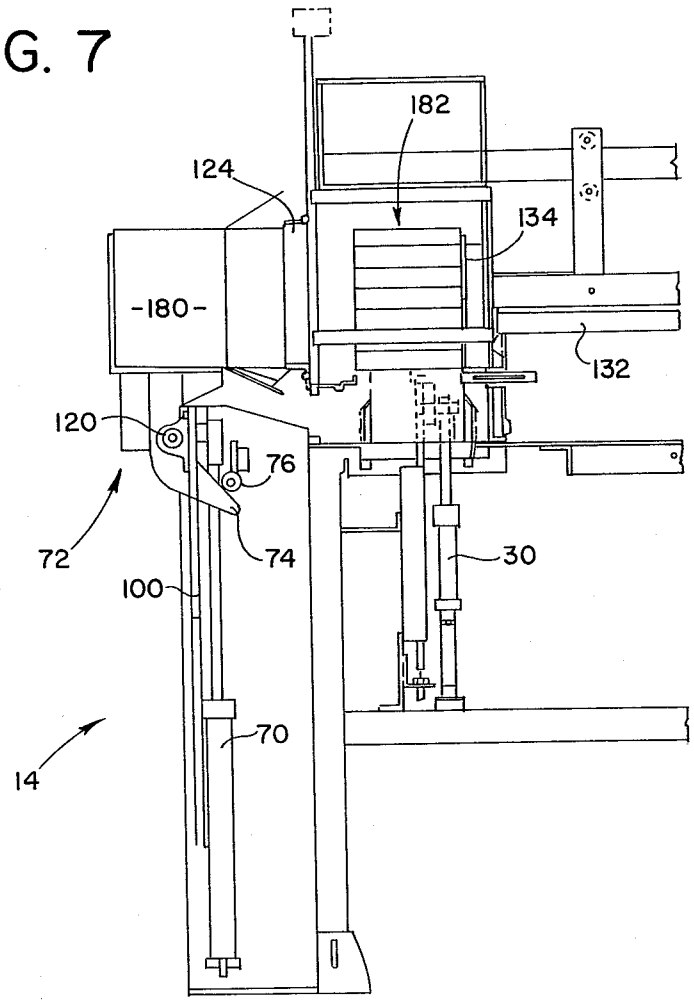
FIG. 7 shows the case of FIG. 6 in a loading position.

With reference now to FIGS. 6 and 7, hydraulic cyliner 70 is actuated to move case 180 from that initial receiving position to the case loading position. More specifically, cylinder 70 is extended to raise slide plate 100 from its lowered position to its raised position; and as slide plate 100 moves upward, case support means 72, case 180, and pivot arm 74 also move upward with it. When slide plate 100 reaches a predetermined height, pivot arm 74 contacts roller 76 and further upward movement of the slide plate causes the pivot arm to pivot about the axis of support rod 120, and this causes case support means 72, and case 180 to pivot about the axis of that support rod. At the same time, further upward movement of slide plate 100 also causes support rod 120 itself to move upward; and the result of this is that case 180 pivots about an upwardly moving axis, bringing the case into its loading positon. As case 180 moves into its loading position, cone 124 becomes nested inside the open end of the case; and among other things, this ensures that the top flaps of the case are held outside the path of movement of articles 182 into the case.

Once case 180 is properly positioned, platform 22 is raised by means of hydraulic cylinder 30 to raise the bottom of the stack of articles 182 to or slightly above, the bottom edge of the front end of cone 124. Then, hydraulic cylinder 132 is extended to push plate 134 forward so that this plate engages the stack of articles 182 and pushes that whole stack across platform 22, through cone 124 and into case 180. Preferably, plate 134 has a size and shape such that the plate contacts the back side of the stack of articles 182 over a substantial portion of the surface area of that back side. After the articles 182 are loaded into case 180, cylinder 132 is retracted to pull plate 134 rearward into its normal position, and cylinder 30 is retracted to lower platform 22 into its normal position.

In addition, once case 180 is loaded with articles 182, cylinder 70 is retracted to return the case to its initial position. As cylinder 70 first retracts, the combined weight of case support means 72, case 180 and the articles in the case forces the case support means and the case to pivot about the axis of support rod 120, with contact between arm 74 and roller 76 limiting or controlling that pivoting movement. At the same time, support rod 120 itself is moving downward with slide plate 100, resulting in case 180 pivoting about a downwardly moving axis. When case 180 and case support means 72 pivot 90°, the side plates of frame 106 contact slide plate 100 and this prevents further downward pivoting movement of the case. Continued retraction of cylinder 70 lowers case support means 72 and case 180 into their initial positions; and from this position, case 180 may be removed from case supoort means 72, either automatically or by hand, and for example the top flaps of the case may then be closed and sealed.

Controls (not shown) may be used to operate cylinders 30, 70 and 132, and these controls may be designed to operate automatically in response to the occurence of certain events, sensed by suitable sensors. For example, hydraulic cylinder 70 may be actuated to raise case 180 to a loading position after stack of articles 182 reaches a certain height, and cylinder 132 may be extended after the case is sensed in its loading position.

Figure 8:
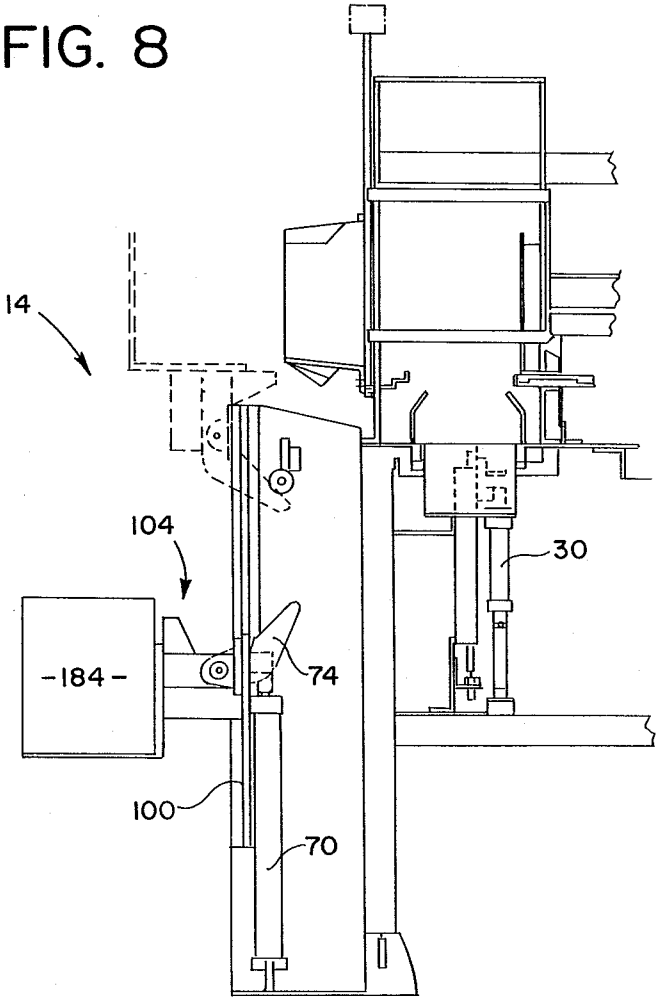
FIG. 8 shows the case packing apparatus a different packing case.

Apparatus 10, and specifically case positioning assembly 14, may be easily adjusted to use cases of different sizes; and in particular, so that, for each of these different case sizes, case support means 72 will position the open top end of the case at substantially the same height and position adjacent to the stack of articles formed by stacking assembly 12. This is done simply by adjusting the height of arms 110 and 112 along frame 106; and more specifically, to use apparatus 10 with shorter or taller cases, arms 110 and 112 are removed and then resecured on frame at 106 higher or lower positions, respectively. For example, FIGS. 4–7 show assembly 14 with case 180; and with reference to FIG. 8, to use assembly 14 with a taller case 184, arms 110 and 112 are removed and then resecured on frame 106 at a lower position. As can be seen by comparing FIGS. 7 and 8, the height of arms 110 and 112 may be adjusted so that the open top ends of the cases 180 and 184 are moved by case support means 72 into virtually the same position despite the fact that the cases themselves have different heights.

In order to match even better the positions of the top ends of the different cases, when these cases are moved to their respective loading positions, it may be desirable to move the position of roller 76 upward, downward, forward or rearward. With the arrangement shown in the drawings, moving roller 76 rearward or downward causes arm 74 to pivot earlier in the path of movement of slide means 66, while moving the roller forward or upward causes arm 74 to pivot later in the path of movement of the slide means. Because of the foregoing, preferably, roller 76 is connected to support and guide means 64 in a manner allowing the position of the roller to be adjusted relatively easily.

For example, with reference to FIG. 3, bar 122 is releasably connected to brace 94 by a bolt 186 extending through slot 190 in that bar. The height of bar 122, and thus of roller 76, can be easily adjusted by loosening bolt 186, moving the bar upward or downward along the bolt, and then retightening the bolt to resecure the bar at a new height. In addition, with reference to FIGS. 1 and 2, side walls may 80 and 82 form slots 192 that receive brace 94, with the brace releasably connected to the side walls in any suitable manner. Brace 94, and thus roller 76, can be moved forward or rearward by temporarily loosening or disconnecting the brace from side walls 80 and 82, moving the brace forward or rearward along slots 192, and then reconnecting the brace to the side walls 80 and 82 at this new location.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. Case packing apparatus for use with a case having an open end, the apparatus comprising:

(A) a stacking assembly to receive a plurality of articles and to form a stack thereof;

(B) a case positioning assembly located adjacent the stacking assembly to receive the case in a receiving position and to move the case in a loading position wherein the open end of the case is located adjacent the stack of articles; said case positioning assembly includes:

(1) case support means for receiving and supporting the case said case support means includes:

(a) a frame;

(b) arm means releasably connected to the frame and extending forward therefrom to receive and support the case;

(2) guide means;

(3) slide means connected to said case support means and guide means and said slide means supported thereby for upward and downward movement and to pivot the case support means about a pivot axis as the case support means moves from the lower position to the upper position to move the case into the loading position;

said case support means is located forward of the pivot axis;

the means to move the case support means between the lower and raised position includes:

(i) motive means connected to said slide means to move said slide means along the case support means and guide means between lower and raised positions, (ii) a pivot arm connected to the case support means and extending rearward of the pivot axis, and (iii) an engagement member connected to and supported by the support and guide means rearward of the pivot axis and above the pivot arm;

said pivot arm being spaced from the engagement member when the slide means is in its lower position, and the pivot arm engaging the engaging member and pivoting the case support means to move the case into the loading position as the slide means is raised from its lower position and into its raised position;

(C) A pusher assembly located adjacent the stacking assembly to push the stack of articles into the case.

2. Apparatus according to claim 1, wherein:

the support and guide means includes:

(i) left and right spaced side wall plates (ii) means connected to the left side wall plate and defining a left, vertically extending channel, and (iii) means connected to the right side wall plate and defining a right vertically extending channel; and the slide means includes a plate extending into the left and right channels and guided by said channels for vertical sliding movement between lower and raised positions.

3. Apparatus according to claim 1, wherein;

the means connecting the case support means to the slide means includes:

(i) a left bracket connected to an extending forward of the slide means, (ii) a right bracket connected to and extending forward of the slide means, and (iii) a support rod supported by and laterally extending between the left and right brackets;

the support rod defines the pivot axis; and the case support means includes (i) a frame connected to the support rod and supported thereby for vertical movement with the support rod and for pivotal movement about the pivot axis, and (ii) arm means connected to the frame and extending forward therefrom to support the case.

4. Apparatus according to claim 1, wherein the engagement member includes a roller rotatably mounted on the support and guide means, directly above the pivot arm.

5. Apparatus according to claim 1, wherein the open end of the case has a preset length, and the stacking assembly includes means to form the stack of articles to a height equal to said preset length.

6. Apparatus according to claim 5, wherein the means to form the stack of articles to said preset length includes:

a vertically movable platform;

a first retaining plate located on a first side of the platform, and projecting over said platform;

a second retaining plate located on a second side of the platform, and also projecting over said platform; and means connected to the platform to move the platform upward and downward to move the plurality of articles upward past and onto the first and second retaining plates.

7. Case packing apparatus for use with a case having an open end, the apparatus comprising:

a stacking assembly to receive a plurality of articles and to form a stack thereof;

a case positioning assembly located adjacent the stacking assembly, to receive the case in a receiving position, and to move the case to a loading position wherein the open end of the case is located adjacent the stack of articles; and a pusher assembly located adjacent the stacking assembly to push the stack of articles into the case;

the case positioning assembly including (i) a support and guide frame having (a) left and right spaced sidewalls, (b) a pair of left rails connected to the left sidewall and forming a left vertically extending channel, and (c) a pair of right rails connected to the right sidewall and forming a right vertically extending channel, (ii) a slide plate extending into the left and right channels and guided by said channels for vertical sliding movement between lower and raised positions, (iii) motive means connected to the slide plate to move said slide plate between the lower and raised positions, (iv) a support rod having an axis, (v) means connecting the support rod to the slide plate for vertical movement therewith, (vi) case support means mounted on the support rod for vertical movement therewith, and for pivotal movement about the axis of the support rod, the case support means extending forward of the support rod, and including first and second arms to receive the case in said receiving position, (vii) a pivot arm connected to the case support means and extending rearward therefrom, through the slide plate, (viii) an engagement member connected to the support and guide frame rearward of the support rod and above the pivot arm, the pivot arm being spaced from the engagement member when the slide plate is in the lower position, and the pivot arm engaging the engagement member and pivoting the case support means to move the case into the loading position as the slide means is raised from the lower position and into the raised position.

8. Apparatus according to claim 7, wherein:

the case support means further includes a frame mounted on the support rod; and said first and second arms are releasably connected to the frame.

9. Apparatus according to claim 8, wherein:

contact between the slide plate and the frame of the case support means limits downward pivoting mvoement of the case support means about the axis of the support rod;

the support and guide frame further includes a top brace connected to and extending between the left and right sidewalls; and the pivot member includes a roller rotatably connected to said top brace.

* * * * *